US006712338B2

(12) United States Patent
Schafer

(10) Patent No.: US 6,712,338 B2
(45) Date of Patent: Mar. 30, 2004

(54) TAHOE RESCUE TOOL—RESCUE HOIST

(76) Inventor: George Brian Schafer, P.O. Box 14108, So Lake Tahoe, CA (US) 96151

( * ) Notice: Subject to any disclaimer, the term of this patent is extended or adjusted under 35 U.S.C. 154(b) by 0 days.

(21) Appl. No.: 09/817,294

(22) Filed: Feb. 19, 2002

(65) Prior Publication Data

US 2001/0048100 A1 Dec. 6, 2001

Related U.S. Application Data

(60) Provisional application No. 60/194,087, filed on Apr. 3, 2000.

(51) Int. Cl.[7] ..... B66D 1/36
(52) U.S. Cl. ..... 254/335; 254/362
(58) Field of Search ..... 254/338, 772, 254/334, 362, 380, 382, 383, 335

(56) References Cited

U.S. PATENT DOCUMENTS 13,429 A * 8/1855 Gesner ..... 254/334
3,664,205 A * 5/1972 Luras ..... 254/334
3,753,551 A * 8/1973 Tidwell ..... 254/334
6,073,917 A * 6/2000 Plummer ..... 242/602.2
6,241,215 B1 * 6/2001 Gersemsky et al. ..... 254/342
6,283,455 B1 * 9/2001 Ascherin et al. ..... 242/397.5
6,523,806 B2 * 2/2003 Bartal ..... 254/323

* cited by examiner

*Primary Examiner*—Emmanuel Marcelo
(74) *Attorney, Agent, or Firm*—Jack Lo

(57) ABSTRACT

A rescue hoist is comprised of a receiver tube attached to a mounting bracket. The receiver tube is for attaching to a tow hitch on a motor vehicle. A motor is attached to a gear head. A flange on the gear head is attached to the mounting bracket. A capstan is attached to an output shaft of the gear head. A rotatable plate is attached to the mounting bracket, and is freely rotatable relative to the mounting bracket about an axis of the capstan. A lead block with rollers is attached to the rotatable plate. A rope is wound around the capstan. A control portion of the rope is gripped by an operator, and a load portion is positioned through the lead block between the rollers and attached to a load. The rotatable plate is automatically rotated to align the lead block with the direction of the load portion.

3 Claims, 2 Drawing Sheets

TAHOE RESCUE TOOL— RESCUE HOIST

CROSS REFERENCE TO RELATED APPLICATION

I claim the priority of provisional application No. 60/194,087 filed on Apr. 3, 2000.

BACKGROUND OF THE INVENTION

1. Field of the Invention

The invention broadly relates to rescue hoists.

2. Prior Art

A rescue hoist is a tool for winding in a rope to pull or raise people to safety. Ordinary capstan hoists require that the angle at which a rope attached to the load leaves the capstan drum must be exactly ninety degrees or the rope is likely to slip off the capstan causing a loss of control of the load being lowered or lifted. This can result in injury or death of rescue personnel and victims. To overcome this safety hazard, a pulley or lead block is attached to a solid object between the capstan and the load that the rope is passed through to assure that the rope always leaves the capstan drum at a constant ninety degree angle. This also requires an exact placement of the hoist relative to the load that is to be raised or lowered. As a result, capstan hoists are seldom used as rescue hoists because of inherent dangers if the hoist is not positioned and set up perfectly, and setting up a capstan hoist properly is generally too time consuming to be practical.

BRIEF SUMMARY OF THE INVENTION

The present rescue hoist is comprised of a receiver tube attached to a mounting bracket. The receiver tube is for attaching to a motor vehicle. A motor is fixedly attached to the mounting bracket. A gear head is attached to the motor. A capstan is attached to the gear head. A rotatable plate is attached to the mounting bracket, and is rotatable relative to the mounting bracket about the axis of the capstan. A lead block with rollers is attached to the rotatable plate adjacent the capstan. A rope is wound around the capstan. A control end of the rope is gripped by an operator, and a load end of the rope is attached to a load, such as a person in distress.

DETAILED DESCRIPTION OF THE INVENTION

Figure 1:
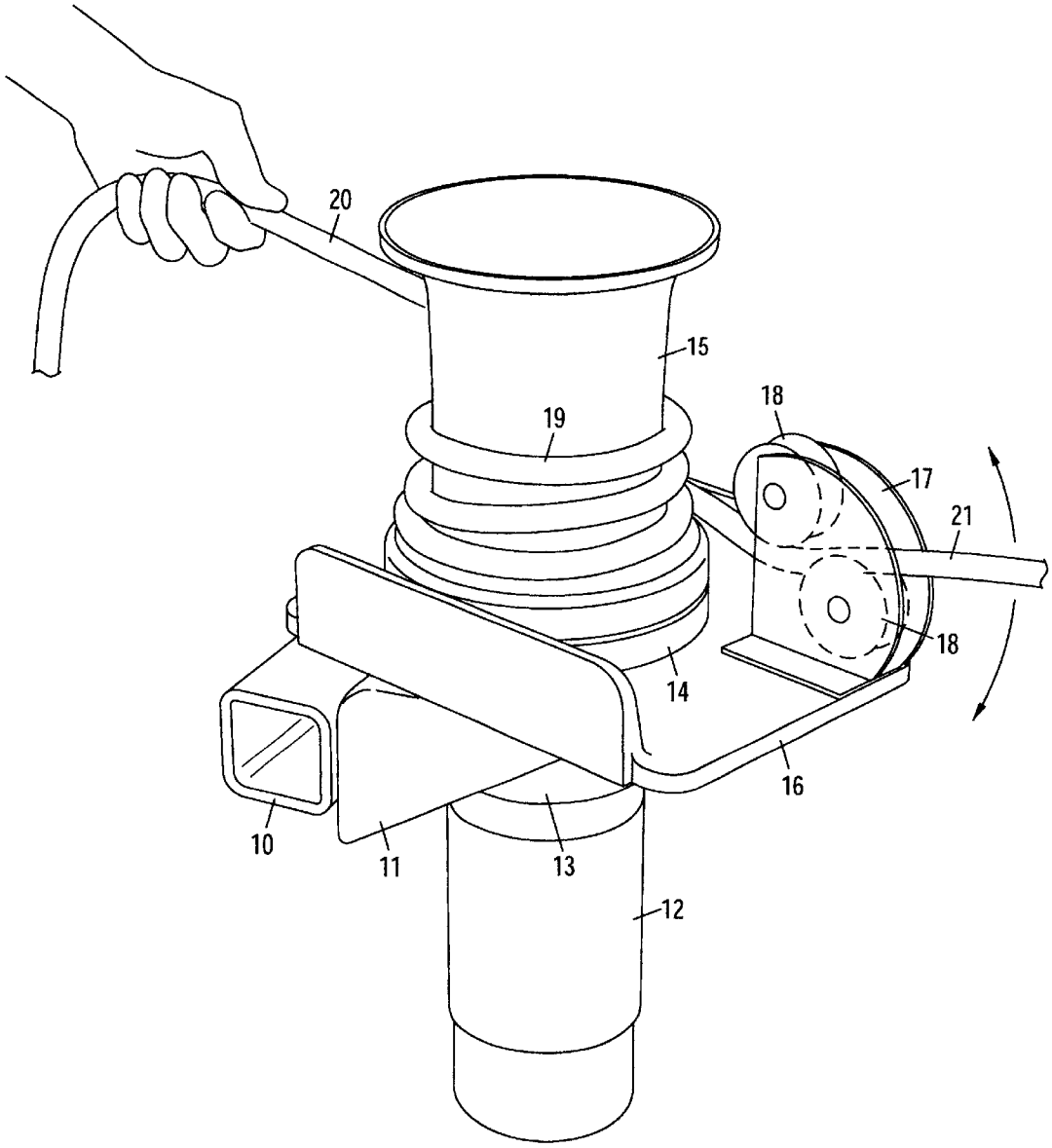
FIG. 1 is a perspective view of the present rescue hoist with a rotatable plate in a first position.

A preferred embodiment of the present rescue hoist is shown in FIG. 1. It is comprised of a receiver tube 10 attached to a mounting bracket 11. Receiver tube 10 is for attaching to a receive-type tow hitch on a motor vehicle (not shown). A motor 12 is attached to a gear head 13. A flange 14 on gear head 13 is attached to mounting bracket 11. Motor 12 may be electric or hydraulic. A capstan 15 is attached to an output shaft (not shown) of gear head 13. A rotatable plate 16 is attached to mounting bracket 11, and is freely rotatable relative to mounting bracket 11 about an axis of capstan 15. A lead block 17 with rollers 18 is attached to rotatable plate 16 adjacent capstan 15. A rope 19 is wound around capstan 15. A control portion 20 of rope 19 is gripped by an operator, and a load portion 21 of rope 19 is attached to a load (not shown), such as a person in distress or debris to be lifted from a collapsed building. Load portion 21 of rope 19 is positioned through lead block 17 between rollers 18, and is movable in a direction parallel to an axis of capstan 15 as shown by the arrows.

Figure 2:
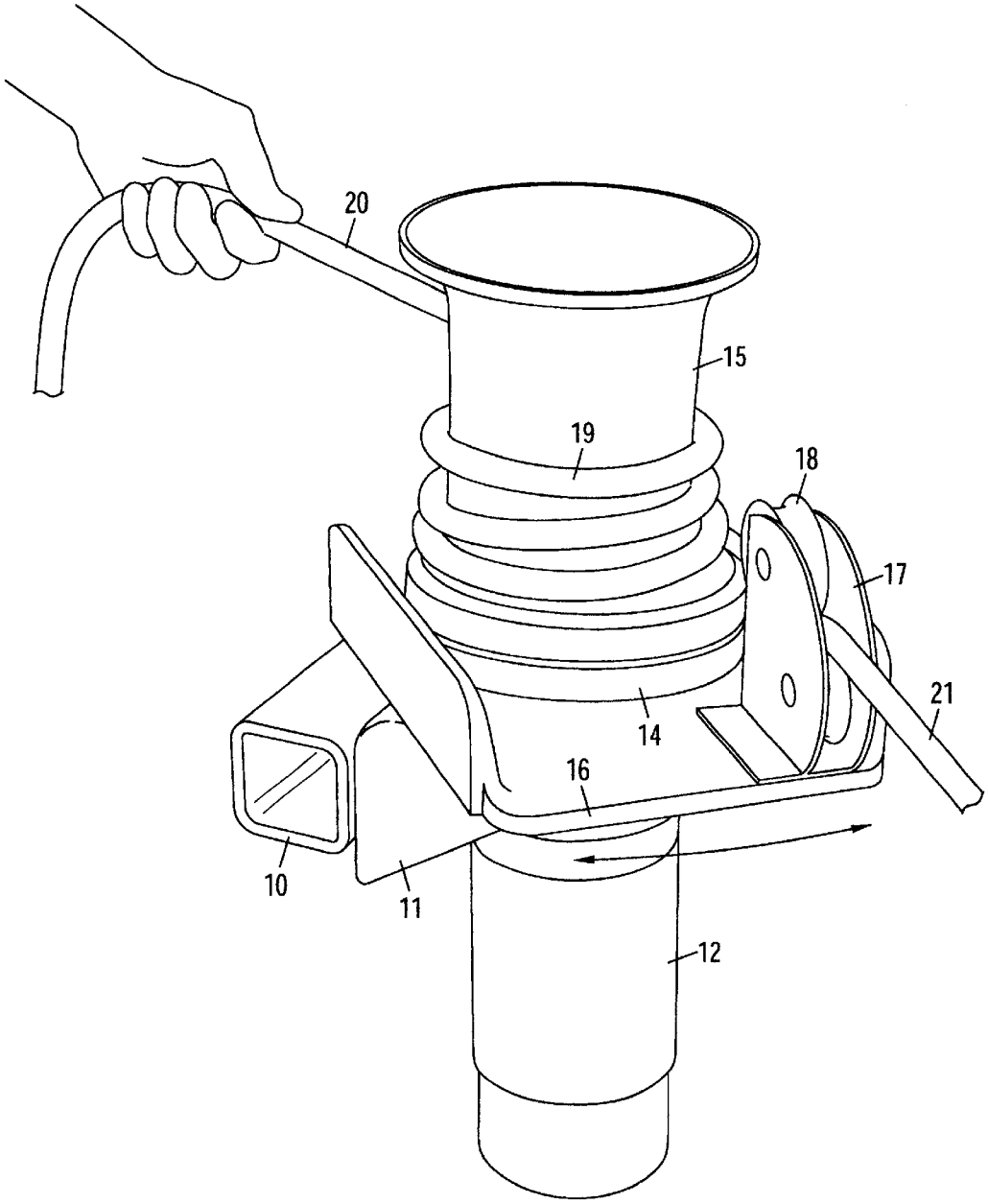
FIG. 2 is a perspective view thereof with the rotatable plate in a second position.

In FIG. 2, rotatable plate 16 is freely rotatable relative to mounting bracket 11 about the axis of capstan 15, as shown by the arrows, to align lead block 17 with the direction of load portion 21 of rope 19.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

What is claimed is:

1. A rescue hoist, comprising:

a mounting bracket;

a motor attached to said mounting bracket;

a capstan connected to said motor for winching a rope; and a lead block for guiding a load portion of said rope extending between said capstan and a load connected to said rope; wherein said lead block is freely rotatable relative to said mounting bracket about an axis of said capstan to automatically align said lead block with a direction of said load portion of said rope.

2. A rescue hoist, comprising:

a mounting bracket;

a motor attached to said mounting bracket;

a capstan connected to said motor for winching a rope;

a rotatable plate attached to said mounting bracket; and a lead block with rollers, wherein said lead block is attached to said rotatable plate for guiding a load portion of said rope extending between said capstan and a load connected to said rope; wherein said lead block is freely rotatable relative to said mounting bracket about an axis of said capstan to automatically align said lead block with a direction of said load portion of said rope.

3. A rescue hoist, comprising:

a receiver tube for attaching to a tow hitch on a motor vehicle;

a mounting bracket attached to said receiver tube;

a motor with a gear head attached to said mounting bracket;

a capstan attached to said gear head for winching a rope;

a rotatable plate pivotally attached to said mounting bracket; and a lead block with rollers, wherein said lead block is attached to said rotatable plate for guiding a load portion of said rope extending between said capstan and a load connected to said rope; wherein said lead block is freely rotatable relative to said mounting bracket about an axis of said capstan to automatically align said lead block with a direction of said load portion of said rope.

* * * * *